US008758035B2

(12) United States Patent
Morello et al.

(10) Patent No.: US 8,758,035 B2
(45) Date of Patent: Jun. 24, 2014

(54) ELECTRICAL CONNECTION SYSTEM THAT INCLUDES AN INTEGRALLY FORMED RETAINING MEANS TO SECURE A SEALING MEMBER DISPOSED THEREIN

(75) Inventors: John R. Morello, Warren, OH (US); James M. Rainey, Warren, OH (US); Steve Ragalyi, Cortland, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 13/466,378

(22) Filed: Jun. 7, 2012

(65) Prior Publication Data

US 2013/0330950 A1 Dec. 12, 2013

(51) Int. Cl.
*H01R 13/52* (2006.01)

(52) U.S. Cl.
USPC ..... 439/271

(58) Field of Classification Search
USPC ..... 439/271, 270
See application file for complete search history.

(56) References Cited

U.S. PATENT DOCUMENTS

| | | | | |
|---|---|---|---|---|
| 4,637,674 | A * | 1/1987 | Kobler | 439/371 |
| 6,244,886 | B1 | 6/2001 | Strange et al. | |
| 6,341,983 | B1 | 1/2002 | Crawford et al. | |
| 8,043,106 | B1 | 10/2011 | Morello et al. | |
| 8,187,042 | B2 * | 5/2012 | Kimura | 439/752 |
| 2009/0035976 | A1 | 2/2009 | Matsunaga | |
| 2011/0287648 | A1 * | 11/2011 | Uchida | 439/271 |

FOREIGN PATENT DOCUMENTS

| | | | |
|---|---|---|---|
| DE | 29504752 | U1 | 7/1996 |
| DE | 202010008250 | U1 | 10/2010 |
| WO | 2007017560 | A1 | 2/2007 |

OTHER PUBLICATIONS

EP Search Report Dated Aug. 30, 2013.

* cited by examiner

*Primary Examiner* — Phuong Dinh
(74) *Attorney, Agent, or Firm* — Robert J. Myers

(57) ABSTRACT

An electrical connection system includes a first connector housing including electrical contacts and a second connector housing including corresponding electrical mating contacts. The first connector housing and electrical contacts are configured to mate with the second connector housing and the electrical mating contacts along a mating axis. At least one of the first and second connector housings includes a sealing member that surrounds the electrical contact associated with the at least one of the first and second connector housings and further contains a retaining means to retain the sealing member therein. The retaining means is integrally formed with the connector housing. A method to construct the electrical connection system that includes the sealing member and the integral retaining means is also presented.

18 Claims, 5 Drawing Sheets

ELECTRICAL CONNECTION SYSTEM THAT INCLUDES AN INTEGRALLY FORMED RETAINING MEANS TO SECURE A SEALING MEMBER DISPOSED THEREIN

TECHNICAL FIELD OF THE INVENTION

This invention generally relates to an electrical connection system that includes a sealing member, more particularly, the electrical connection system includes a pair of connector housings that are mateable together in which one of the connector housings contains an integrally formed retaining means that secures the sealing member therein.

BACKGROUND OF THE INVENTION

It is known to use sealing members in electrical connection systems to provide protection for electrical contacts of the connection system from the elements such as water and dirt that may undesirably affect the electrical and/or mechanical performance of the connection system.

One such conventional sealing member (1), referring to FIGS. 1A and 1B, surrounds electrical contacts of in an electrical connection system and includes extended darts (2) that are inserted within a housing (3) of an electrical connection system. Openings (4) defined in the housing (3) secure the sealing member (1) to the housing (3). The sealing member (1) needs to be undesirably orientated in a single way for insertion into the housing (3) that may require extra labor and increased cost to fabricate the electrical connection system. Such a sealing member is also undesirably more complex to manufacture which further increases the cost to assemble the electrical connection system. Another type of electrical connection system contains a separate piece, or provision that snaps into the connector housing that assists to secure the sealing member thereto. As electrical devices remain prevalent in vehicles, the need for electrical connection systems and the sealing members to environmentally protect them, will also remain in demand.

Thus, an electrical connection system includes a robust, integral retaining means that secures a sealing member to a housing of the electrical connection system that allows the sealing member to environmentally protect the electrical connection system while facilitating an easier fabrication of the electrical connection system at a decreased overall cost.

BRIEF SUMMARY OF THE INVENTION

In accordance with one embodiment of the invention, an electrical connection system includes first connector housing and a second connector housing. The first connector housing includes at least one electrical contact. The second connector housing includes at least one electrical mating contact. The second connector housing and associated mating contact is configured to mate to the first connector housing and the first connector housing's electrical contact along a mating axis. At least one of the respective connector housings includes a sealing member that surrounds the electrical contact associated with the at least one of the respective connector housings and the at least one connector housing that includes the at least one sealing member further contains at least one retaining means to retain the sealing member therein. The retaining means is integrally formed with the at least one connector housing.

In accordance with another embodiment of the invention, a method to construct an electrical connection system includes at least one connector housing that contains a sealing member. One step in the method is providing the connector housing in which the connector housing includes a cavity that is configured to receive at least one electrical contact. Another step in the method is inserting the sealing member within the cavity to surround the at least one electrical contact. A further step in the method is forming at least one retaining means on at least a portion of the connector housing in a manner so that the formed retaining means secures the sealing member to the connector housing therein.

Further features, uses and advantages of the invention will appear more clearly on a reading of the following detailed description of the embodiments of the invention, which is given by way of non-limiting example only and with reference to the accompanying drawings.

BRIEF DESCRIPTION OF THE SEVERAL VIEWS OF THE DRAWING

This invention will be further described with reference to the accompanying drawings in which.

DETAILED DESCRIPTION OF THE INVENTION

Figure 1A:
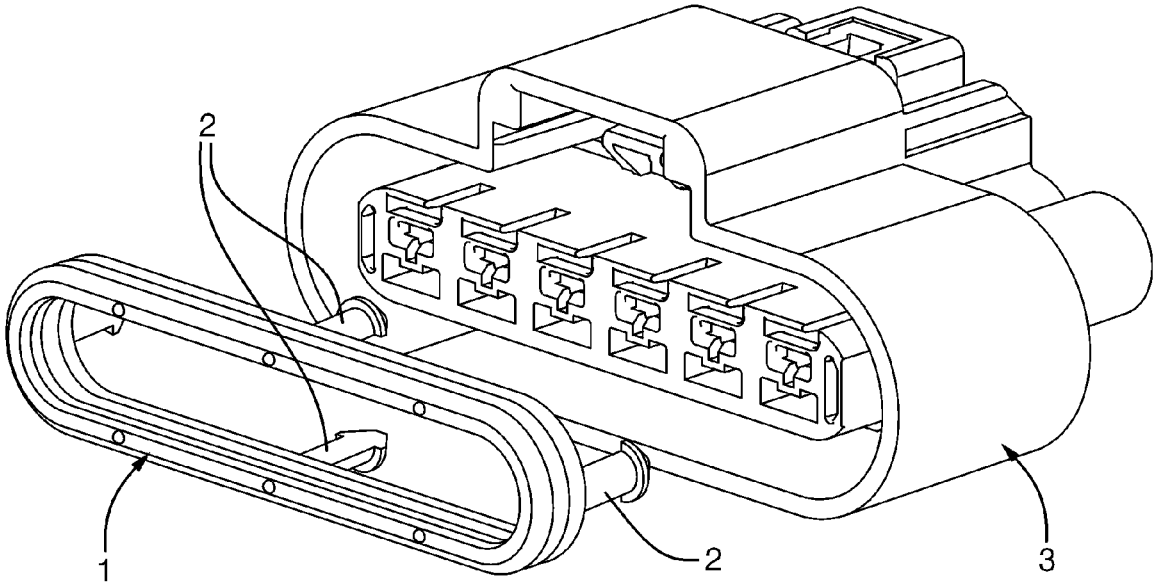
PRIOR ART FIG. 1 A
FIGS. 1A and 1B show an electrical connection system that has a conventional sealing member that contains darts being inserted in a cavity of the electrical connection system.
Figure 1B:
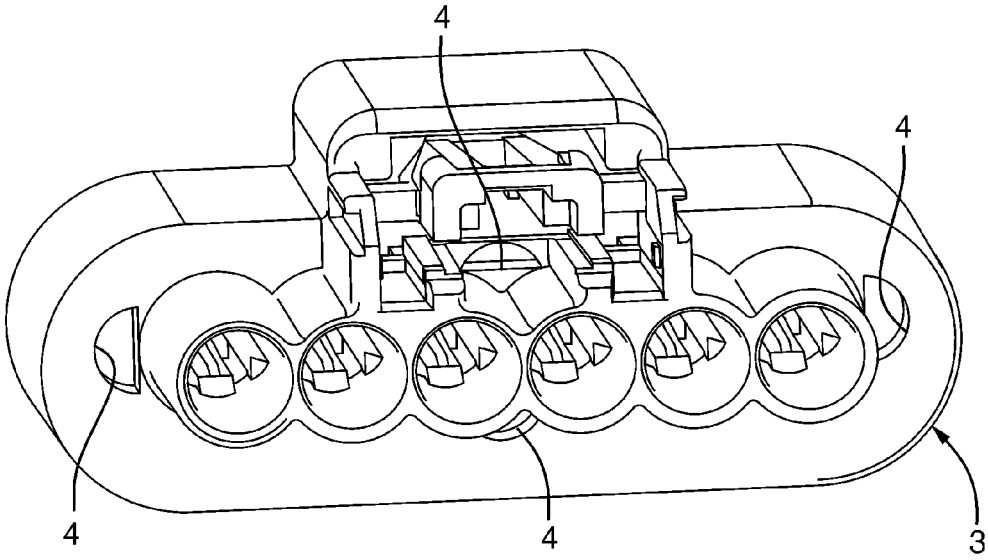
PRIOR ART FIG. 1 B

Electrical wiring harnesses that include electrical connection systems are used in the transportation industries. Such industries include the vehicular, truck, marine, and airline industries. Electrical connection systems used in these industries may also find use in non-motorized transportation vehicles such as golf carts and the like. All of these electrical applications may benefit from an electrical connection system that contains an integrally formed retaining means formed on one of the housings of the electrical connection system to secure a sealing member of the electrical connection systems therein. If the sealing member separates, dislodges, or becomes disorientated on the connector system, the connector system may experience undesired environmental intrusion that may negatively impact the electrical performance of electrical devices disposed in electrical communication with the electrical connection system.

In accordance with an embodiment of this invention, then, referring to FIGS. 2-4 and 6, an electrical connection system 10 includes a first connector housing 12 and a second connector housing (not shown). First connector housing 12 includes at least one electrical contact 16 disposed therein. The second connector housing includes at least one mating electrical contact (not shown) disposed therein. First connector housing 12 and associated electrical contacts 16 are configured to mate with the second connector housing and the corresponding electrical contacts along a mating axis A.

First connector housing 12 is configured to receive a sealing member 20 that surrounds electrical contacts 16 when electrical contacts 16 are received in openings 22 of first connector housing 12. First connector housing 12 also contains at least one retaining means 22 to retainingly secure sealing member 20 therein. At least one retaining means 24 is integrally formed with first connector housing 12, as best illustrated in FIG. 3B. First connector housing 12 and the second connector housing are formed of a non-electrically conducting dielectric material, preferably plastic. Even more preferably, the connector housings are formed from a glass-filled plastic material. First connector housing 12 and the second connector housing are constructed by injection molding in a mold 141 by any known method as is known in the electrical connector arts.

First connector housing 12 contains a cavity 26. The second connector housing is received in cavity 26 through a front end 29 of first connector housing 12. A rearward end 31 of first connector housing 12 is axially opposingly remote from front end 29. An extended raised portion 28 extends from a floor 30 of cavity 26. Extended raised portion 28 defines openings 22 that formed in a row 32 that are configured to receive and secure electrical contacts 16 within first connector housing 12. Cavity 26 is configured to matingly receive the second connector housing and the associated mating electrical contacts along mating axis A. Electrical contacts 16 and the mating electrical contacts are fabricated from any electrically conducting material, such as any metal material, as is also known in the electrical connector arts.

Figure 5:
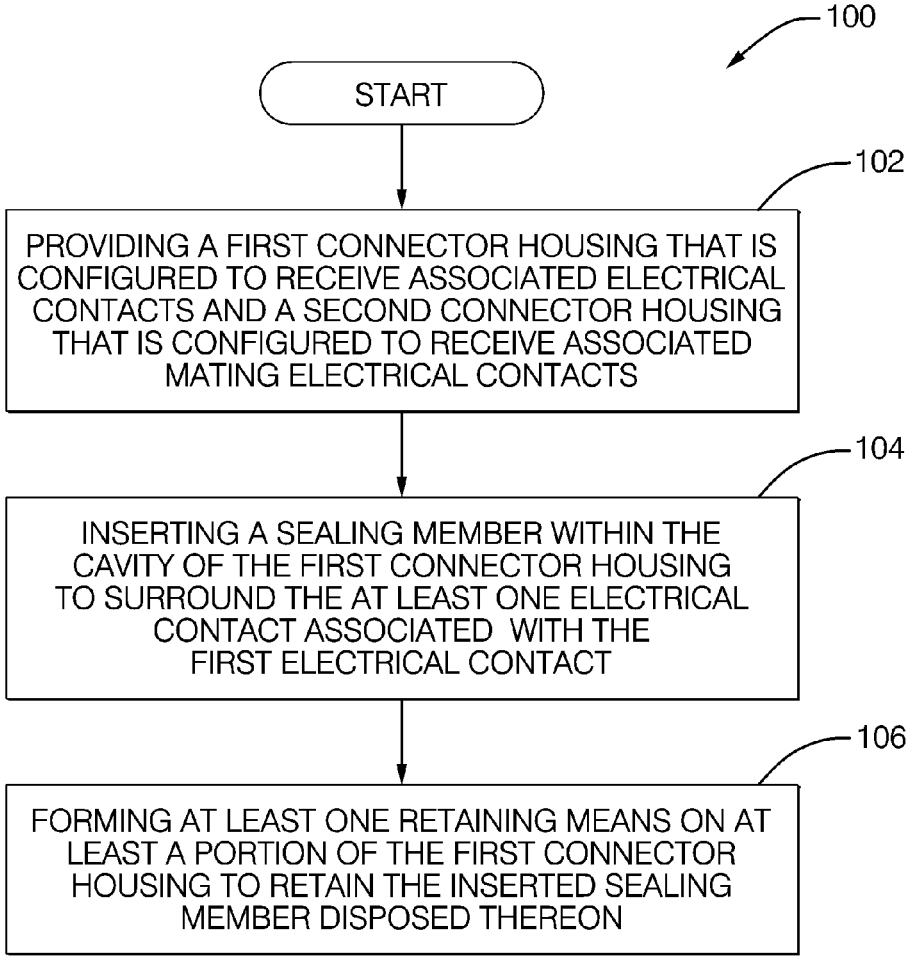
FIG. 5 shows a method to manufacture the electrical connection system that includes the retaining means of FIG. 3B to secure the sealing member to a housing of the electrical connection system.

Referring to FIG. 5, a method 100 to construct electrical connection system 10 is presented. One step 102 in method 100 is providing first connector housing 12 that has associated electrical contacts 16 and the second connector housing that includes the associated mating electrical contacts. First connector housing 12 includes a cavity 26 configured to receive the second connector housing along with first connector housing's electrical contacts 12 along mating axis A all of which has been previously described herein. Another step 104 in method 100 is inserting sealing member 20 within cavity 26 to surround the at least one electrical contact 16 of first connector housing 12. A further step 106 in method 100 is forming at least one retaining means 24 on at least a portion of first connector housing 12 from material of first connector housing 12 in a manner so that the formed, integral retaining means 24 retainingly secures sealing member 20 to first connector housing 12 therein.

Figure 2A:
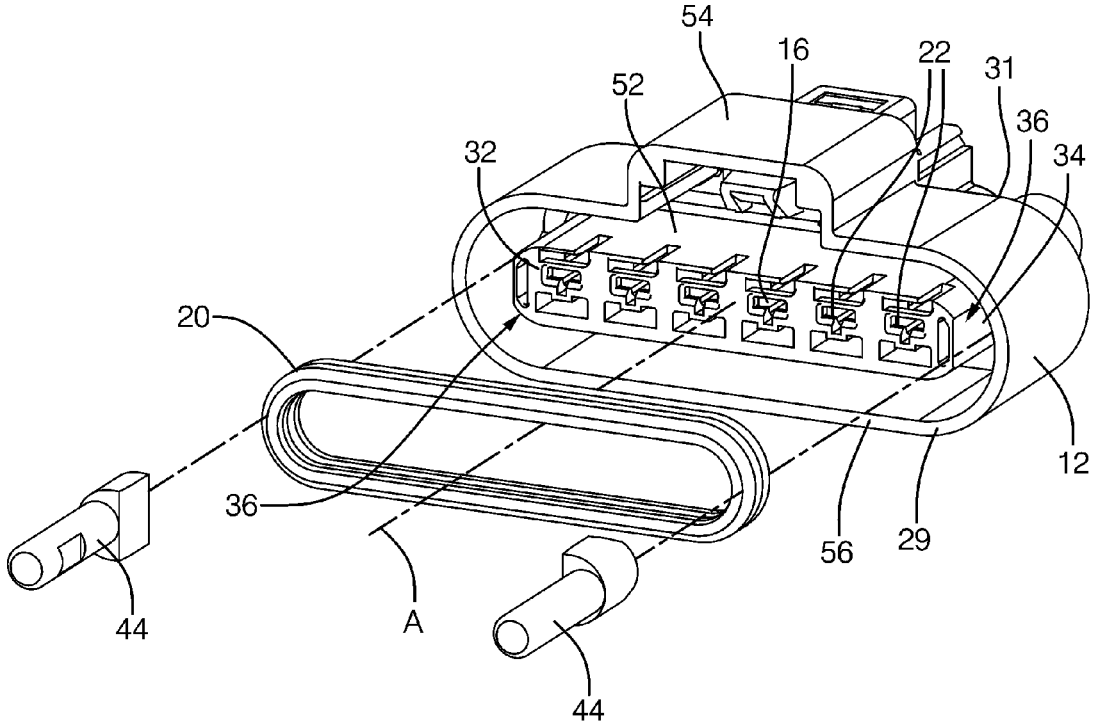
FIG. 2A shows a housing of an electrical connection system that includes a stepped-shaped element from which an integral retaining means is formed, in accordance with the invention.
Figure 2B:
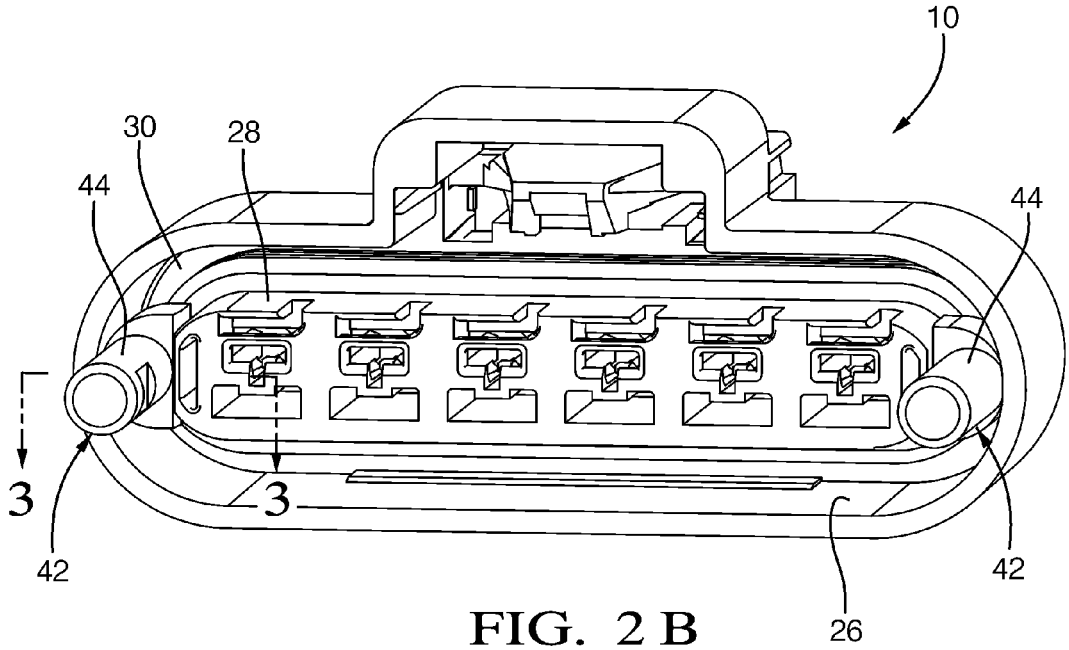
FIG. 2B shows a tool inserted in a cavity of the housing of the electrical connection system of FIG. 2 that forms the integral retaining means.
Figure 3A:
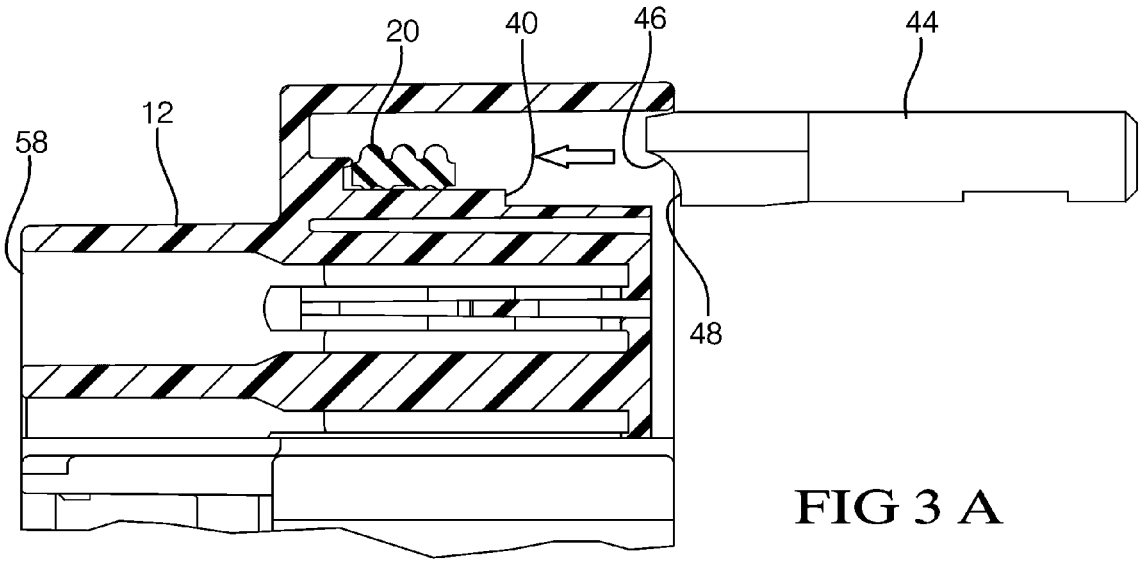
FIG. 3A shows a topical cross-section view of the tool of FIG. 2B being inserted in the cavity of the housing just prior to the integral retaining means being formed.
Figure 3B:
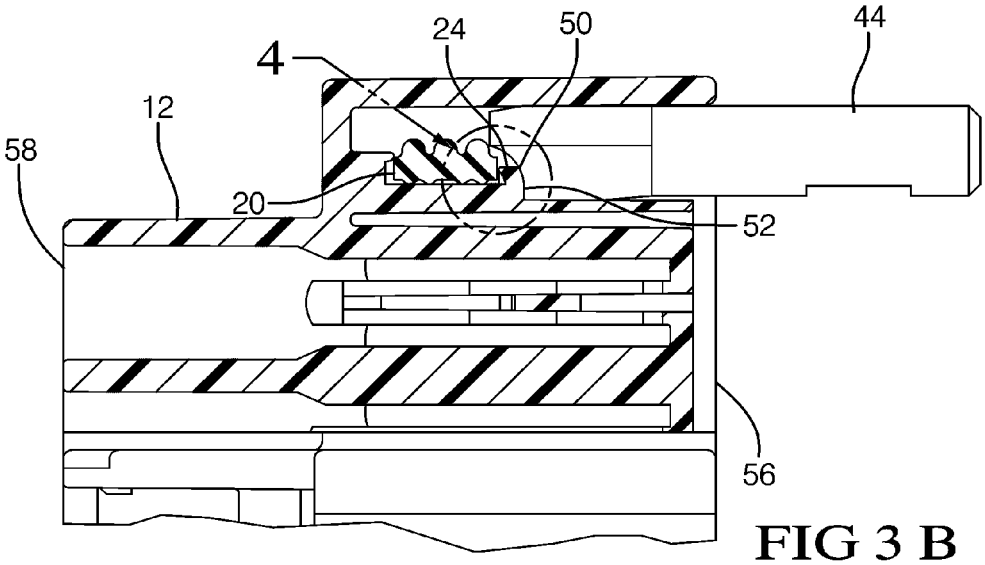
FIG. 3B shows a topical cross-section view after the integral retaining means is formed in the housing by the tool of FIG. 2B.
Figure 4:
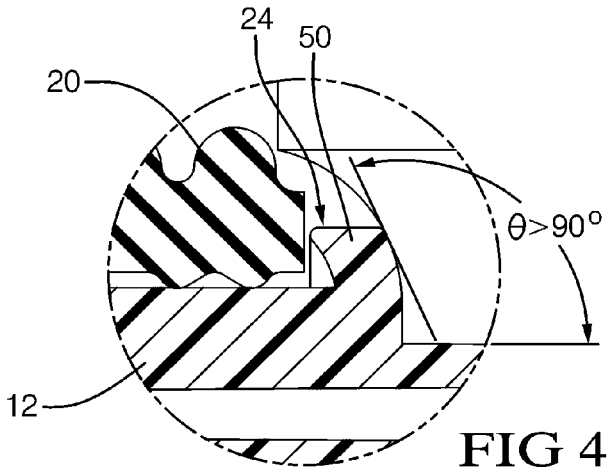
FIG. 4 shows a magnified view of the integral retaining means of FIG. 3B, and angular disposition details of the integral retaining means thereat.

Referring to FIGS. 2A, 2B, 3A, 4 and 6, when first connector housing 12 is molded from dielectric material 139 being supplied to mold 141, a pair of step-shaped members 34 are molded at lateral ends 36 of row 32 along extended raised portion 28. Step-shaped members 34 are best seen in FIGS. 2A and 3A and include step 40 of step-shaped member 34. Turning to FIG. 2B, a pair of tools 42 are inserted via a press in cavity 26 proximate step-shaped member 34 and step 40. Tool 42 includes pins 44 that have an end 46 that each have an arcuate portion 48. Arcuate portion 48 engages steps 40 on step-shaped members 34 and movingly pushes or axially plows step 40 and the material axially behind step 40 to form retaining means 24. Pins 44 are connected to a press that supplies a force that allows pins 44 to form retaining means 24. The press may be any kind of press used to cold form the retaining means as is known in the connector arts. Retaining means 24 is a tab 50 that is integrally formed from the material of extended raised portion 28 that outwardly extends away from an external surface 52 of extended raised portion 28 adjacent sealing member 20. In this way, step 106 of method 100 is undertaken by deforming step 40 by pin 44 in a cold forming process to produce tab 50. This cold forming process is performed external to mold 141 in a manufacturing assembly process 125 used to fabricate electrical connection system 10. Tab 50 is disposed abuttingly adjacent sealing member 20, as best illustrated in FIG. 4. In some embodiments, the tab may actually physically touch a portion of the sealing member. Tab 50 is constructed so that sealing member 20 is sufficiently retainingly secured to first connector housing 12 such that sealing member 20 will not extend over tab 50 and come off extended raised portion 28 over the product service lifetime of electrical connection system 10 when electrical connection system 10 is disposed in a given electrical applications. For example, the product service lifetime of motorized vehicle may be ten (10) years. Further, as best shown in FIG. 4, tab 50 is formed by arcuate portion 48 to have an angle of rotation Θ in relation to external surface 52 of extended raised portion 28 of greater than 90 degrees. External surface 52 of extended raised portion 28 generally extends perpendicular to floor 30 which is also generally parallel with mating axis A when first connector housing 12 is mated with the second connector housing. Thus, tab 50 also has angle of rotation Θ in relation to axis A that is greater than 90 degrees, as best illustrated in FIG. 4. Tab 50 having angle of rotation Θ of greater than 90 degrees advantageously ensures sealing member 20 is further retained in first connector housing 12 as tab 50 is angularly slanted towards sealing member 20 by angle of rotation Θ. In this manner, being disposed on extended raised portion 28, tab 50 does not communicate with an outer external surface 54 of first connector housing 12. Integral retaining means 24 allows the generally oval-shaped sealing member 20 to be installed on first connector housing 12 along a first side 56 or a second side 58 making the assembly process to fabricate the electrical connection system 10 easier. These types of sealing members may be desirably purchased at a decreased cost over the darted sealing member as described in the Background of the Invention herein. Sealing member 20 may be formed of any dielectric material, preferably a silicone rubber material that is flexible in its normal state. While the pair of step-shaped members and the fabricated retention means are disposed at the lateral ends of the row of electrical contacts, alternatively, the step-shaped member may be formed an any location along an edge of the sealing member to further retain the sealing member. Still yet alternatively, any number of step-shaped members and retaining means may be formed in a housing of the electrical connection system to retain the sealing member.

Figure 6:
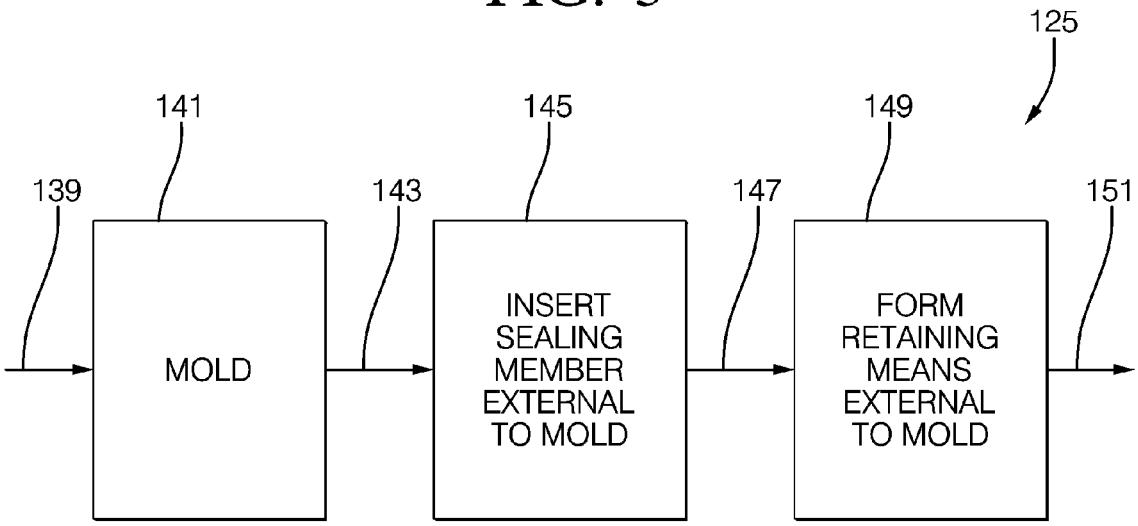
FIG. 6 shows a block diagram of a manufacturing process flow into a mold and other manufacturing steps downstream from the mold in relation to the method of FIG. 5.

Referring to FIG. 6, at least a portion of a manufacturing assembly process 125 to form retaining means 24 is presented. Plastic material 139 is supplied to an injection mold 141. Mold 141 molds the first connector housing. The molded first connector housing 12 is output from mold 141 as denoted at reference numeral 143. Manufacturing assembly process steps 145, 149 are performed external to mold 141. A further manufacturing process step of inserting sealing member 20 on molded first connector housing 12 is denoted by reference numeral 145. Molded first connector housing 12 with inserted sealing member 20 is an output denoted at reference numeral 147. Another process step of assembly process 125 is to form retaining means 24 to secure inserted sealing means 20 to molded first connector housing 12 and is denoted by reference numeral 149. And the molded first connector housing 12 with the inserted sealing member 20 and the formed retaining means 24 is an output as denoted at reference numeral 151. Formed retaining means 24 retains the peripheral, inserted sealing member 20 with at least a nine (9) newton minimum force. Other steps in the manufacturing assembly process may include build-out of the first connector housing with wiring assemblies that include an electrical contact in electrical communication with a wire cable (not shown) along with construction of a more complex wiring harness. A shear force of greater than nine (9) newtons applied to the retaining means would be needed to shear the retaining means as fabricated and described herein from the connector housing.

Step 106 of method 100 of forming retaining means 24 may further be facilitated by heating of the tool prior to forming the retaining means. Generally, the tool is heated to a level that is above room temperature. In one embodiment, it has been observed that heating the tool to 100 degrees Celsius and then forming the retaining means was effective. A heated tool that engages step 40 may assist to soften the housing material proximate a localized area of step 40 so that the retaining means is more easily formed. This heated tool approach may be more advantageous to form the retaining means especially if a material more rigid that glass-filled plastic material is used to form the connector housings. This approach may also ensure a longer life of the retaining means. Should the retaining means break off, the sealing member may undesirably become dislodged within the electrical connection system when the first connector housing is unmated from the second connector housing. Replacement of the at least a portion of the electrical connection system undesirably increases cost to service the electrical connection system. Alternatively, the first connector housing may be heated so as to provide a more malleable material so that the retaining means may be more easily formed with an unheated tool. Still yet alternatively, the tool in combination with the first connector housing may both be heated and then the retaining means formed.

Electrical connection system 10 is not in use when first connector housing 12 is not mated with the second connector housing. If sealing member 20 is not disposed on first connector housing 12 and/or retaining means 24 is not formed in first connector housing 12, electrical connection system 10 is also not in use.

Electrical connection system 10 is in use when first connector housing 12 and the second connector housing are mated together such that electrical signals may be carried on electrical contacts 16 and the electrical contacts of the second connector housing in and through electrical connection system 10. When electrical connection system 10 is in use, sealing member 20 is disposed on first connector housing 12 and retaining means 24 is formed in first connector housing 12 to retainingly secure sealing member 20 therein.

Figure 7:
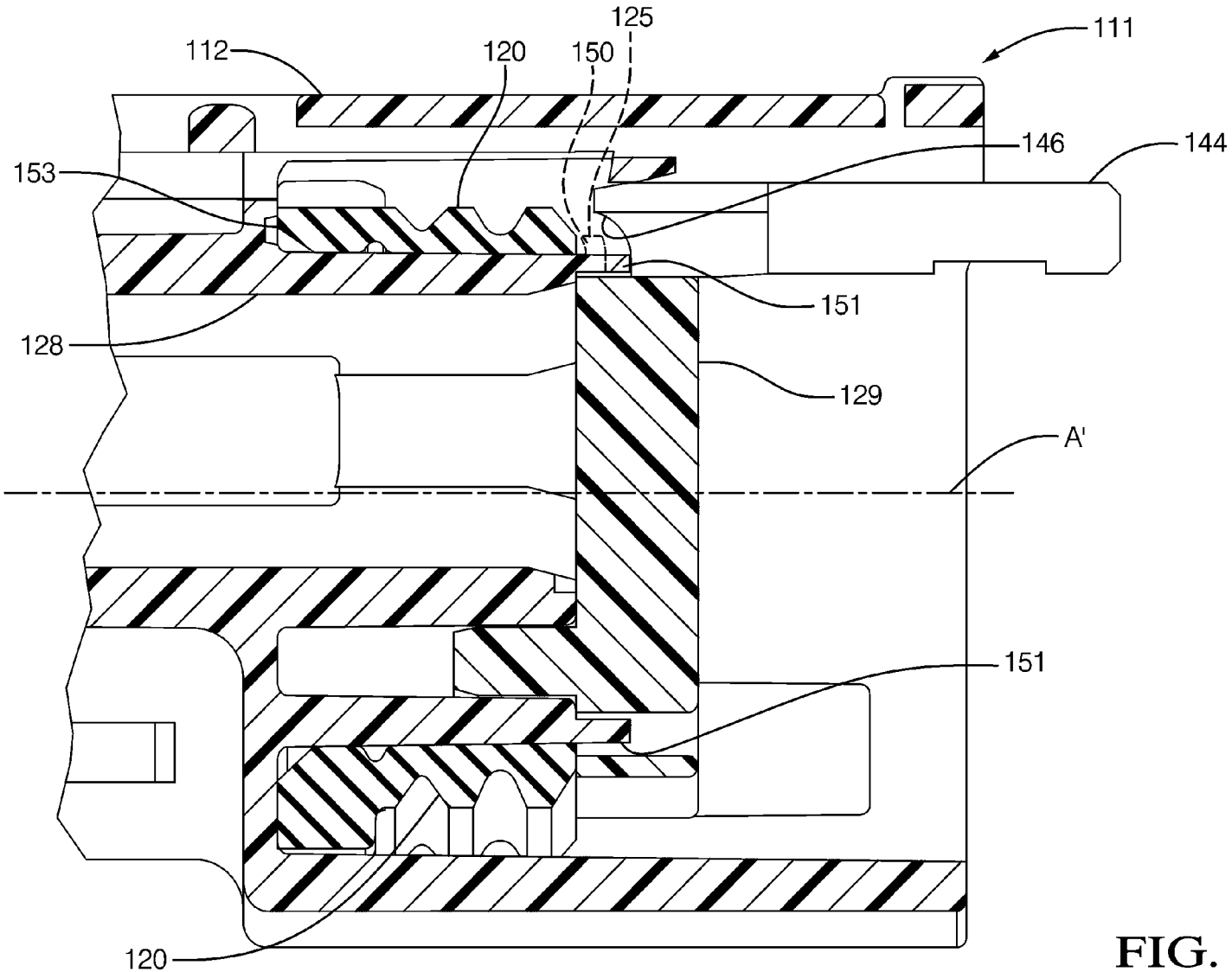
FIG. 7 shows an electrical connection system that includes a retaining means with the sealing member disposed proximate a front end of the connector housing, according to an alternate embodiment of the invention.

Referring to FIG. 7, according to an alternate embodiment of the invention, an electrical connection system 111 disposed along a mating axis A' and includes at least one retaining means 125. Electrical connection system 111 is similar to electrical connection system 10 and reference numerals that are similar to elements in the embodiment of FIGS. 2-4 differ by 100. In contrast to the embodiment of FIGS. 3 and 4, a sealing member 120 is moved forward on an extended raised portion 128 being disposed proximate a front end 129 of first connector housing 112. Sealing member 120 is inserted through front end 129 on to extended raised portion 128 seating at a rearward shoulder 153 of first connector housing 112. At least one retaining means 125 is formed similarly by cold forming similarly to the embodiment of FIGS. 3 and 4 as previously discussed herein. However, retaining means 125 is formed from an axially extended tab 151 that is plowed by an end 146 of a tool 144. Similar to the embodiment of FIGS. 3 and 4, end 146 has an arcuate shape and retaining means 125 is a tab 150 that has an angle of rotation Θ (not shown) in relation to axis A' that is greater than 90 degrees. First connector housing 112 and second connector housing (not shown) are made of similar materials as the connector housings of the embodiments of FIGS. 3 and 4, and the tool and/or the first connector housing may also be heated and then the retaining means, as previously described herein in the embodiments of FIGS. 3 and 4.

Alternatively, the electrical connection system may be constructed such that the sealing member is disposed on, and the retaining means is formed as part of the second connector housing.

Alternatively, while the electrical connection system has a generally oval-type shape as shown in the embodiment of FIGS. 2-4, the electrical connection system may have any shape and employ the retaining means as described herein.

Still alternatively, the electrical contacts may comprise male and corresponding female terminals. One of these electrical contact types may be disposed in one of the connectors and the other electrical contact types may be disposed in the other one of the connectors dependent on the configuration of the electrical connection system needed in any particular electrical application of use.

Alternatively, while a 9 newton retention force is previously described herein for the retaining means to retain the sealing member, the retaining means may be fabricated to have a retention force that is greater or less than the 9 newton retention force and is dependent on the electrical application where the electrical connection system that includes the retaining means may be employed. Still yet alternatively, the retaining means may be fabricated to have a given shear force requirement that is also dependent on the electrical application of use.

Still yet alternatively, the retaining means may be formed within the mold after the first connector housing is initially molded.

Thus, an electrical connection system that includes a robust, integral retaining means that secures a sealing member to a housing of the electrical connection system has been presented. The integral retaining means allows the sealing member to environmentally protect the electrical connection system while facilitating an easier fabrication of the electrical connection system at a decreased overall cost. There are no extra pieces to install or more complex sealing members to install as described previously in the Background herein. The use of the retaining means allows a lower-cost, but still effective sealing member to be utilized. A more simplified, lower cost sealing member in contrast to the darted sealing member described in the Background may be installed along a first side or a second side as no specific orientation is needed during fabrication of the electrical connection system when using the retaining means. With the retaining means being formed as a tab during a cold forming process having an angle of rotation of greater than 90 degrees further ensures the sealing member is retained on the first connector housing over a lifetime of the electrical connection system regardless of the number of times the first and the second connector housing are mated/unmated. In certain vehicle electrical applications, this service life may be ten (10) years. Heating of the tool or the first connector housing, or both, may allow easier formation of the retaining means and ensure a robust retaining means over the service life of the vehicle. The electrical connection system may be constructed so that a simplified sealing member at any designated location along a height of the extended raised portion of the first connector housing. This may mean the sealing member may be disposed deep in the cavity of the first connector housing or disposed proximate the opening of the first connector housing as is required by the electrical application of use. Cold forming the retaining means adds little to no additional manufacturing cost of the electrical connection system.

While this invention has been described in terms of the preferred embodiment thereof, it is not intended to be so limited, but rather only to the extent set forth in the claims that follow.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connection system comprising:

a first connector housing defining a cavity configured to receive a second connector housing, wherein the cavity further defines a step-shaped member;

a sealing member disposed within the cavity and adjacent the step-shaped member;

a retaining means configured to retain said sealing member within said first connector housing, wherein said retaining means is integrally formed by deforming a portion of said step-shaped member and wherein the portion of the step-shaped member is axially plowed to form said retaining means; and a plurality of electrical contacts disposed in a row in the first connector housing, and the retaining means is disposed along said row and laterally outboard of the plurality of electrical contacts.

2. The electrical connection system according to claim 1, wherein said retaining means is adjacent to and abutting with said sealing member.

3. The electrical connection system according to claim 1, wherein said first connector housing and said retaining means are formed of a dielectric material.

4. The electrical connection system according to claim 1, wherein said retaining means extendingly transitions outwardly away from an external surface of the step-shaped member and angularly towards the sealing member.

5. The electrical connection system according to claim 1, wherein the retaining means comprises a plurality of retaining means respectively disposed along the row and laterally outboard of the plurality of electrical contacts.

6. The electrical connection system according to claim 1, wherein the electrical connection system is a part of an electrical wiring harness within a motorized vehicle.

7. A method to construct an electrical connection system, the method comprising:

providing a first connector housing configured to receive an electrical contact and defining a cavity configured to receive a second connector housing, wherein the cavity further defines a step-shaped member configured to receive a sealing member;

inserting the sealing member within the cavity adjacent to the step-shaped member, and subsequently;

deforming at least a portion of the step-shaped member, thereby forming a retaining means that secures the sealing member within the cavity.

8. The method according to claim 7, wherein the first connector housing is fabricated within a mold and wherein the retaining means is integrally formed external to the mold.

9. The method according to claim 7, wherein the step-shaped member is axially deformed and wherein said step-shaped member is an extended raised portion extending from a floor of the cavity of the first connector housing.

10. The method according to claim 7, wherein said retaining means is integrally formed from material of the first connector housing.

11. The method according to claim 7, wherein said retaining means is produced by a cold forming process.

12. The method according to claim 11, wherein the deforming step occurs after the providing step.

13. The method according to claim 12, wherein said first connector housing is formed within a mold and wherein the deforming step is performed external to said mold.

14. The method according to claim 7, wherein a tool is used to deform the step-shaped member.

15. The method according to claim 14, wherein the-deforming step further includes, heating the tool, and deforming the step-shaped member with said tool after the tool is heated.

16. The method according to claim 14, wherein the tool comprises a pin.

17. The method according to claim 16, wherein the pin comprises an end that contains an arcuate shape and the arcuate shape engages the portion of the step-shaped member to form said retaining means.

18. The method according to claim 9, wherein the portion of the step-shaped member is axially plowed to form said retaining means.

* * * * *